US008172592B2

(12) United States Patent
Ogura et al.

(10) Patent No.: US 8,172,592 B2
(45) Date of Patent: May 8, 2012

(54) CONNECTOR HAVING A ROTATABLE PRESS MEMBER

(75) Inventors: Yoshiyuki Ogura, Kanagawa (JP); Yasuyoshi Yoshikai, Kanagawa (JP)

(73) Assignee: Iriso Electronics Co., Ltd., Kanagawa (JP)

( * ) Notice: Subject to any disclaimer, the term of this patent is extended or adjusted under 35 U.S.C. 154(b) by 0 days.

(21) Appl. No.: 12/996,653

(22) PCT Filed: Apr. 23, 2010

(86) PCT No.: PCT/JP2010/057249

§ 371 (c)(1), (2), (4) Date: Dec. 7, 2010

(87) PCT Pub. No.: WO2010/140437

PCT Pub. Date: Dec. 9, 2010

(65) Prior Publication Data

US 2011/0092091 A1 Apr. 21, 2011

(30) Foreign Application Priority Data

Jun. 3, 2009 (JP) ..... 2009-133980

(51) Int. Cl.
*H01R 13/62* (2006.01)

(52) U.S. Cl. ..... 439/260

(58) Field of Classification Search ..... 439/260, 439/495, 492, 325, 497

See application file for complete search history.

(56) References Cited

U.S. PATENT DOCUMENTS

| | | | | |
|---|---|---|---|---|
| 6,332,801 | B1 * | 12/2001 | Watanbe | 439/409 |
| 7,179,118 | B1 * | 2/2007 | Harlan et al. | 439/495 |
| 8,043,104 | B2 * | 10/2011 | Taketomi | 439/260 |
| 2009/0221178 | A1 * | 9/2009 | Hirata et al. | 439/497 |
| 2009/0258523 | A1 * | 10/2009 | Nemoto | 439/325 |

FOREIGN PATENT DOCUMENTS

| | | |
|---|---|---|
| JP | 2002-352890 | 12/2002 |
| JP | 2008-277068 | 11/2008 |
| JP | 2009-070757 | 4/2009 |

* cited by examiner

*Primary Examiner* — Chandrika Prasad

(74) *Attorney, Agent, or Firm* — Lowe Hauptman Ham & Berner, LLP

(57) ABSTRACT

A connector configured to effectively prevent an incomplete connection caused by an imperfect insertion of an object to be connected. A tip of a flexible circuit inserted into a connector main body abuts against a lock member, a press member is rotated toward one direction while the lock member is moved toward outside in the width direction of the connector main body, a protrude portion of the press member abuts against the lock member so that the rotation of the press member becomes regulated, and the press member is rotated toward one direction while the lock member is returned toward inside in the width direction of the connector main body, the press member is allowed to rotate, therefore, the press member does not rotate to the closed position while the flexible circuit is imperfectly inserted.

6 Claims, 9 Drawing Sheets

CONNECTOR HAVING A ROTATABLE PRESS MEMBER

RELATED APPLICATIONS

The present application is based on, and claims priority from, JP Application Number 2009-133980, filed Jun. 3, 2009, and PCT Application Number PCT/JP10/057249, the disclosures of which are hereby incorporated by reference herein in their entireties.

TECHNICAL FIELD

The present invention relates to a connector to connect, for example, flexible printed circuits, flexible flat cables, or the like.

BACKGROUND

Conventionally, a connector having a connector main body of which a front side is configured so that one side of an object to be connected (referred to as a flexible circuit) such as FPC or FFC or the like is capable of being inserted, a plurality of contacts arranged in the width direction of the connector main body, and a press member capable of rotating for pushing the flexible circuit which is inserted in the connector main body toward the contacts (for example, see Japanese Patent publication No. 2008-277068) is known.

In this connector, when the press member is rotated toward the closing direction in a situation in which the flexible circuit is inserted in the connector main body, the flexible circuit and the contacts touch tightly and connect with each other. Also, when the press member is rotated toward the opening direction, the tight touch between the flexible circuit and each of the contacts is released, and the insertion and the extraction of the flexible circuit from the connector main body becomes capable.

Also, the connector has a lock member which locks the flexible circuit by engaging with dented portions provided at both ends in the width direction of the flexible circuit. When the flexible circuit is inserted completely in the connector main body, the lock member engages to the dented portions, when the flexible circuit is not inserted completely, the lock member touches the upper surface of the flexible circuit and the lock member is moved upwardly. Also, whether the flexible circuit is being inserted completely or not is judged by watching the state of the lock member.

SUMMARY

In prior connectors known to the inventors, when the lock member is moved upwardly by means of incomplete insertion of the flexible circuit, the press member is capable of rotating to the closed position. Therefore, if the incomplete insertion is not noted by watching inspection, the press member is closed and connection between the flexible circuit and the contacts is completed in the imperfect insertion state. Therefore, it is impossible to surely prevent incomplete connections by the watching inspection.

A purpose of one or more embodiments of the present invention is to provide a connector capable of preventing the incomplete connections by means of the incomplete insertion of the object to be connected.

To achieve the above object, in one or more embodiments of the present invention, a connector comprises a connector main body into which an object to be connected can be inserted, a plurality of contacts arranged with spaces in the width direction of the connector main body, a rotatable press member for pushing the contacts toward the object to be connected which is inserted in the connector main body, a lock member which locks the object to be connected by engaging to an engagement portion provided at both width ends of the object to be connected, wherein each of the contacts is pushed toward the object to be connected by the press member when the press member is rotated toward one direction, and the pushing of the contacts by the press member is released when the press member is rotated toward the other direction, when the tip of the object to be connected inserted into the connector main body touches the lock member, the lock member is deformed springy so that the lock member moves from a predetermined position toward the outside in the width direction of the connector main body, when the lock member is engaged with the engagement portion of the object to be connected, the lock member moves toward the inside in the width direction of the connector main body and returns to the predetermined position, when the press member is rotated toward the one direction in a state in which the lock member is being moved from the predetermined position toward the outside in the width direction of the connector main body, both width ends of the press member abut against the lock member from a direction which is perpendicular to the width direction of the connector main body, and the abutting regulates the rotation of the press member, when the press member is rotated toward the one direction in a state in which the lock member is being returned to the predetermined position, the rotation of the press member is permitted.

By this, when the press member is rotated toward one direction in a state in which the lock member is being moved from the predetermined position toward a predetermined direction, a predetermined part of the pushing press member abuts against the lock member, and the abutting regulates the rotation of the press member, the press member can not be rotated toward one direction in a state in which the object to be connected is inserted imperfectly. In such case, the lock member moves in the width direction of the connector main body. So, it is unnecessary to enlarge the connector main body in its height direction. Also, when the insertion is imperfect, the press member abuts against the lock member moved toward outside in the width direction of the object to be connected from a direction which is perpendicular to the width direction of the connector main body. Therefore, a press force to the press member is not applied to the object to be connected through the lock member.

According to one or more embodiments of the invention, the pushing press member does not rotate toward one direction in a state in which the object to be connected is imperfectly inserted, therefore, it effectively prevents the incomplete connection caused by the imperfect insertion of the object to be connected. In such case, it becomes unnecessary to enlarge the connector main body in its height direction, which is extremely advantageous to make the connector main body thinner. Also, the press force to the press member is not applied to the flexible circuit through the lock members. Therefore, it is advantageous that the flexible circuit does not get damaged.

DETAILED DESCRIPTION

Figure 1:
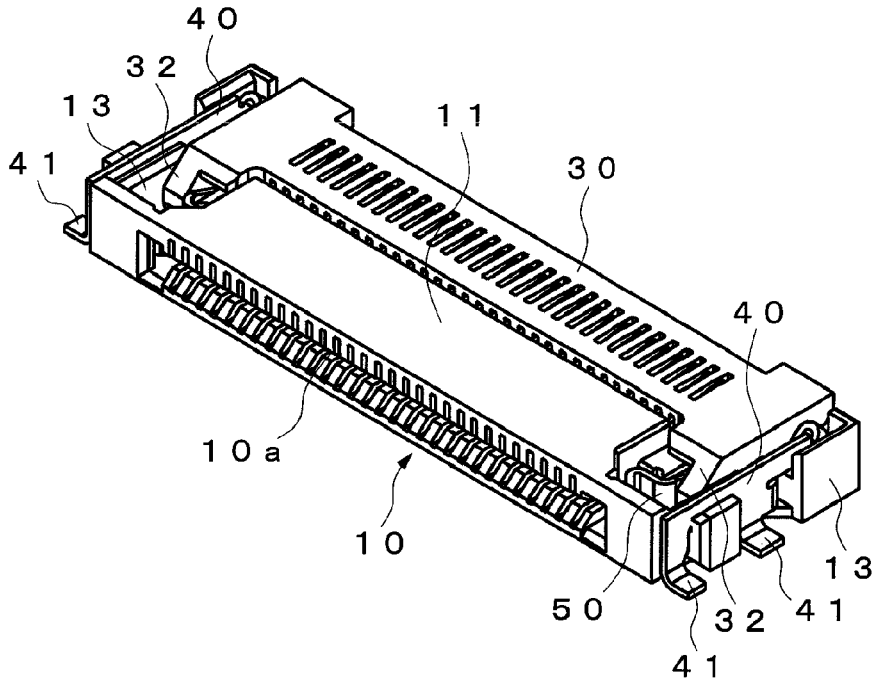
FIG. 1 is a front side perspective view of a closed state connector showing first embodiment of this invention.
Figure 2:
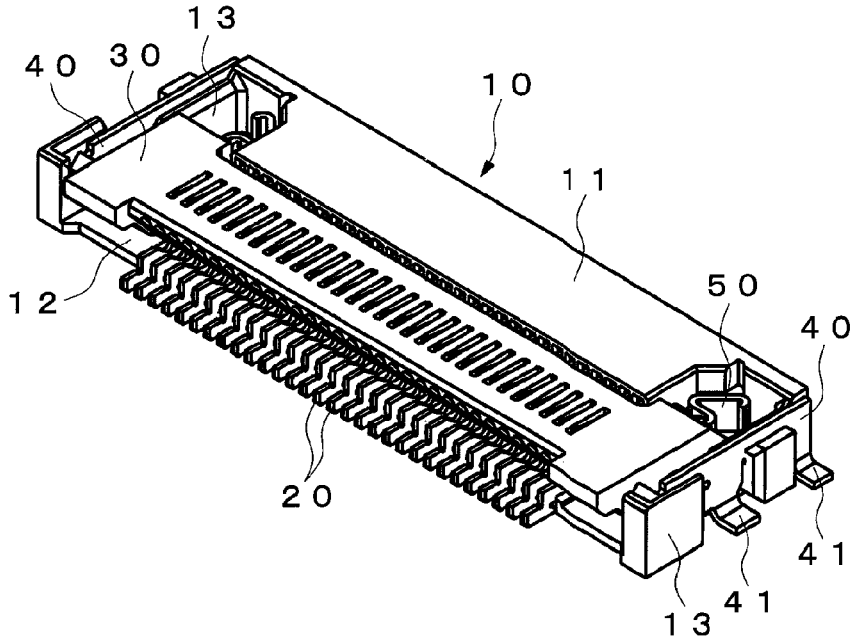
FIG. 2 is rear side perspective view of the closed state connector.
Figure 3:
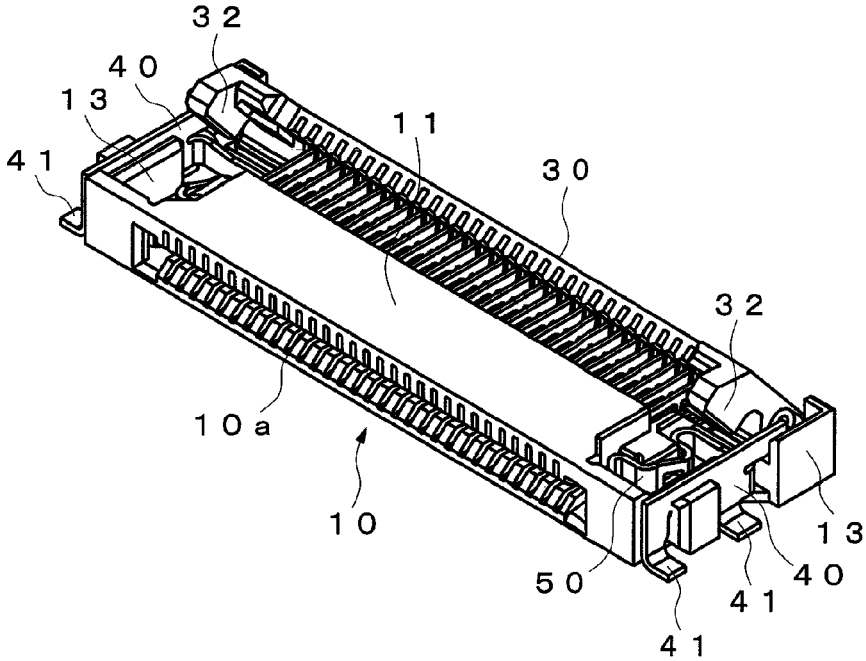
FIG. 3 is a front side perspective view of an opened state connector.
Figure 4:
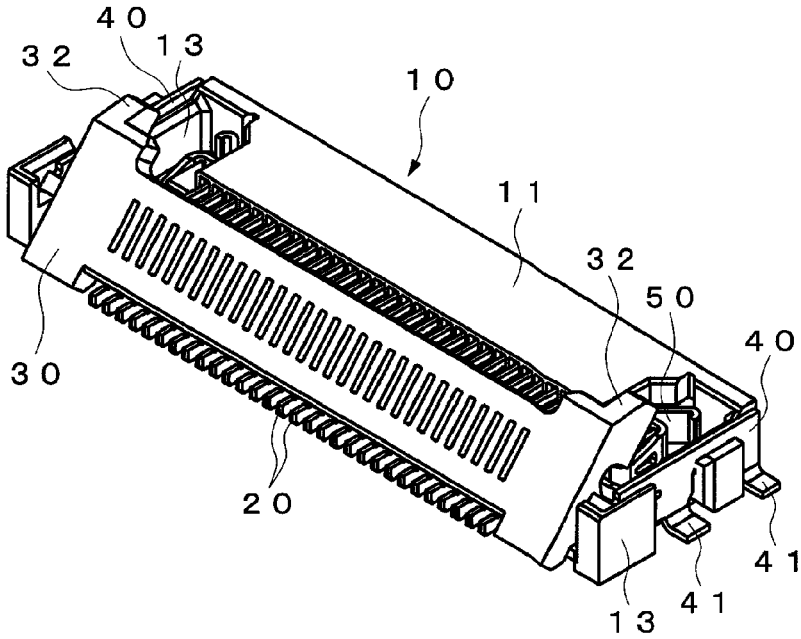
FIG. 4 is a rear side perspective view of the opened state connector.

FIGS. 1 through 11 show a first embodiment of the present invention. A connector shown in said FIGS. comprises a connector main body 10 into which a flexible circuit 1 (FIG. 5A) to be inserted as an object to be connected, a plurality of contacts 20 (FIG. 2) arranged with spaces in the width direction of the connector main body 10, a press member 30 capable of rotating for pushing each contacts toward the flexible circuit 1 side which is inserted into the connector main body 10, a pair of left/right fixing members 40 for fixing the connector main body 10 to a circuit board which is not shown in any of FIGS., and a pair of left/right lock members 50 with which the flexible circuit 1 is engaged.

The flexible circuit 1 is configured of what is called a flexible flat cable (FFC) or a flexible printed circuit (FPC), a plurality of electrical metal terminals (not shown) is provided at an upper face of a tip side of the flexible circuit 1 with spaces in the width direction. Also, dented portions 1*a* (FIG. 9) as the engagement portion for being engaged with the lock members 50 is provided at both end sides in the width direction of the flexible circuit 1. When the flexible circuit 1 is inserted into a predetermined position of the connector main body 10 (position for connecting with the contacts 20), each of the lock members 50 is engaged with the dented portions respectively.

The connector main body 10 is made of a synthetic resin molding, and an insertion slot 10*a* for inserting the flexible circuit 1 is provided at a front face of the connector main body 10. The connector main body 10 comprises an upper face portion 11, a bottom face portion 12, and left and right side face portions 13, the upper face portion 11 is configured only at the front end side of the upper face of the connector main body 10. Also, both of the left and right sides of the upper face portion 11 are opened to expose the inside of the connector main body 10, and the lock members 50 are disposed at the exposed portions.

Each of the contacts 20 is made of a conductive metal plate which is arranged at the bottom face portion 12 of the connector main body 10 with spaces in the width direction. Each of the contacts 20 comprises a fixing piece portion 21 for fixing with the bottom face portion 12, a first movable piece portion 22 pushed by the press member 30, a second movable piece portion 23 arranged at the lower side of the first movable piece portion 22, and a springy piece portion 24 formed between the second movable portion 23 and the fixing piece portion 21.

The fixing piece portion 21 extends in the front-rear direction of the connector main body 10, a front end portion 21*a* thereof is pushed into a slit at the bottom face portion 12 side. A connecting portion 21*b* for connecting to a circuit board, which is not shown in any of FIGS., is provided at the rear end of the fixing piece portion 21, the connecting portion 21*b* extends toward backward of the connector main body 10. A first convex portion 21*c* capable of rotatably engaging with the press member 30 is provided at the rear end side of the fixing piece portion 21, and a first concave portion 21*d* is provided at the front side of the first convex portion 21*c*.

The first movable piece portion 22 extends in the vertical direction of the connector main body 10, a first contacting portion 22*a* for contacting the upper face of the flexible circuit 1 is provided so as to protrude downwardly at the front end of the movable piece portion 22. A first abutting portion 22*b* and a second abutting portion 22*c* for abutting against the press member 30 are provided at the rear end of the first movable piece portion 22, the first contacting portion 22*b* is provided at the rear end side of the first movable piece portion 22 downwardly inclining from upper side to the lower side, the second abutting portion 22*c* is formed approximately horizontally in the front-rear direction at the bottom end face of the first movable piece portion 22.

The second movable piece portion 23 extends toward the front-rear direction of the connector main body 10, a second contacting portion 23*a* for contacting the upper side of the flexible circuit 1 is provided to protrude downwardly at the front end of the second movable piece portion 23. In this embodiment, the second movable piece portion 23 is shorter than the first movable piece portion 22 in the front-rear direction of the connector main body 10, and the width of the second movable piece portion 23 is smaller in the front-rear direction than the width of the first movable piece portion 22. Also, the second contacting portion 23*a* is placed at the rear side of the first contacting portion 22*a*, the lower end of the second contacting portion 23*a* is the same height as the lower end of the first contacting portion 22*a* (contacting point). The rear end side of the second movable piece portion 23 bends upwardly and extends toward the rear end side of the first movable piece portion 22 (ahead of the second abutting portion 22*c*), the first movable piece portion 22 is supported by the rear end side of the second movable piece portion 23.

The springy piece portion 24 extends in the vertical direction from an approximate center in the front-rear direction of the fixing piece portion 21 to an approximate center in the front-rear direction of the second movable piece portion 23, the first movable piece portion 22 and the second movable piece portion 23 are respectively supported so that the front end sides and rear end sides of the first movable piece portion 22 and the second movable piece portion 23 are respectively movably in the vertical direction.

The press member 30 is made of a synthetic resin molding and the press member 30 covers the upper face in the rear end side of the connector main body 10. A rotation support portion 31 protruding toward the inside of the connector main body 10 is provided at the rear end side of the press member 30. A second convex portion 31*a* for engaging with the first concave portion 21*c* of the contacts 20 is provided at the tip of the rotation support portion 31. A second convex portion 31*b* for engaging with the first concave portion 21*d* of the contacts 20 is provided at the front part of the second concave portion 31*a*. In other words, the press member 30 rotates on a fulcrum where the second concave portion 31*a* contacts the first convex portion 21*c* by engaging the second concave portion 31*a* with the first convex portion 21*c*, and the press member 30 rotates on a fulcrum where the second convex portion 31*b* contacts the first concave portion 21*d* by engaging the second convex portion 31*b* with the first concave portion 21*d*. In this embodiment, the fulcrum is located between the front end side and the rear end side of the press member 30, when the front end side of the press member 30 is pushed downwardly, the rear end side thereof moves upwardly and locks the press member 30, and when the rear end side of the press member 30 is pushed downwardly, the front end side thereof moves upwardly and releases the press member 30. Also, a press portion 31*c* for abutting against the first abutting portion 22*b* and the second abutting portion 22*c* of the contacts 20 is provided at the rotation support portion 31, the press portion 31*c* protrude in a chevron shape. Protruding portions 32 as the width ends of the press member 30 for regulating the lock members 50 from moving in the width direction are provided at both end sides in the width direction of the press member 30, and each of the protruding portions 32 as the width ends of the press member 30 protrude downwardly.

The fixing members 40 are made of a metal plate arranged at the both end sides in the width direction of the connector main body 10, each of the fixing members 40 are fixed to both side face portions 13 of the connector main body 10. Connecting portions 41 which connect to a circuit board (not shown), are provided at the bottom end side of the fixing member 40, each of the connecting portions 41 extend outside in the width direction of the connector main body 10.

Each of the lock members 50 are made of a metal plate integrally formed with the fixing members 40, each of the lock members 50 is arranged at both ends side in the width direction of the connector main body 10. The lock members 50 comprise an engagement portion 51 for being engaged with the dented portion la of the flexible circuit 1, a movable portion 52 extending backwardly from the engagement portion 51, and a springy portion 53 extending to the fixing members 40 from the rear end of the movable portion 53. The engagement portion 51 and the movable portion 52 move toward the width direction of the connector main body 10 by the springy portion 53 deforming springy. Compared to the movable portion 52, the engagement portion 51 is formed in a chevron shape so as to protrude toward inside in the width direction of the connector main body 10, the movable portion 52 extends straight in the front-rear direction of the connector main body 10. The springy portion 53 extends toward the inside in the width direction of the connector main body 10 from the rear end of the movable portion 52, and the springy portion 53 is bent to extend toward the outside in the width direction of the connector main body 10 to the fixing members 40, the engagement portion 51 and the movable portion 52 move in the width direction of the connector main body 10 by deforming the springy portion 53 springy toward the front-rear direction of the connector main body 10. In this embodiment, when the springy portion 53 is not deformed, a slit into which the protruding portion 32 of the press member 30 can be inserted is provided between the movable portion 52 and the side face portion 13 of the connector main body 10, and when the movable portion 52 is moved toward the outside in the width direction of the connector main body 10, the protruding portion 32 abuts against the movable portion 52 so that the protruding portion 32 is regulated from being inserted in the slit.

Figure 5A:
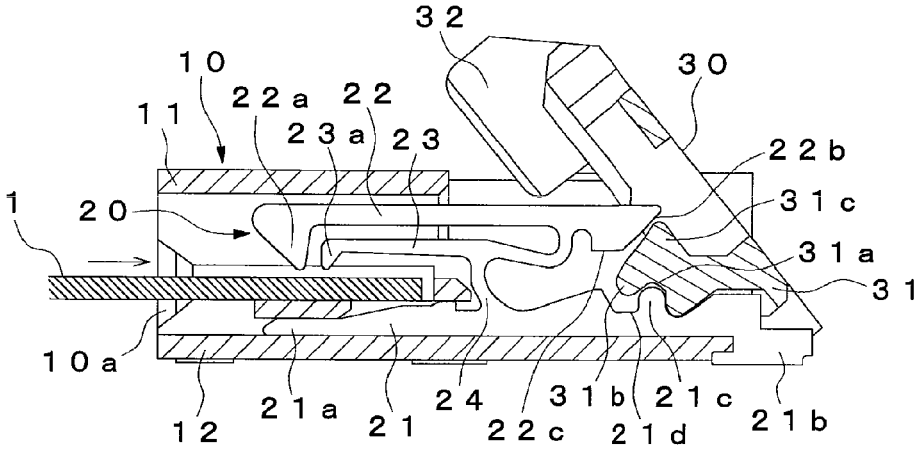
FIG. 5A is a side sectional view showing a closing operation of the connector.
Figure 5B:
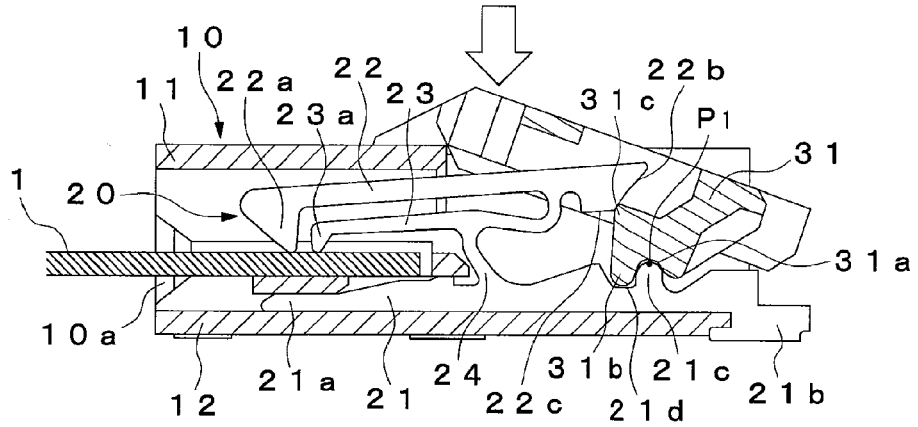
FIG. 5B is a side sectional view showing the closing operation of the connector.
Figure 5C:
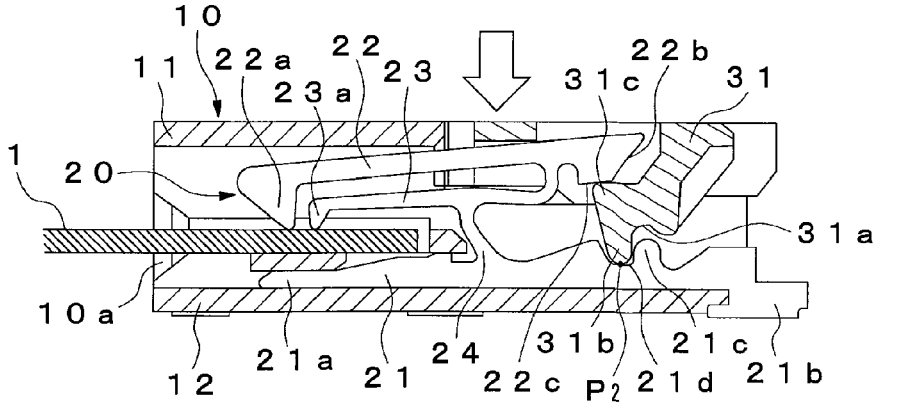
FIG. 5C is a side sectional view showing the closing operation of the connector.

For the above configured connector, as shown in FIG. 5A, while the press member 30 is released, the flexible circuit 1 is inserted into a predetermined position in the connector main body 10 from the insertion slot 10*a*, as shown in FIG. 5B, when the front end side of the press member 30 is pushed downwardly, while the second concave portion 31*a* of the press member 30 is engaged with the first convex portion 21*c*, the press member 30 rotates on a place where the second concave portion 31*a* contacts with the first convex portion 21*c* as a first rotation fulcrum P1, the press portion 31*c* of the press member 30 abuts with the first abutting portion 22*b* of the first movable piece portion 22 toward the front direction. At that time, the first abutting portion 22*b* inclines downwardly toward the front direction, thus, the rear end side of the first movable piece portion 22 is pushed upwardly and the front end side thereof is inclined due to the press portion 31*c*, and, in accordance with this, the rear end side of the second movable piece portion 23 is pushed upwardly and the front end side thereof is inclined. By this, the first contacting portion 22*a* and the second contacting portion 23*a* touch tightly the upper face of the flexible circuit 1, and each of the movable piece portions 22 and 23 is electrically connected to the flexible circuit 1. Next, as shown in FIG. 5C, when the front end side of the press member 30 is pushed further downwardly, the second convex portion 31*b* is engaged with the first concave portion 21*d*, the second concave portion 31*a* is detached from the first convex portion 21*c*, the press member 30 rotates on a place where the second convex portion 31*b* contacts with the first concave portion 21*d* as a second rotation fulcrum P2. By this, the rotation fulcrum of the press member 30 is shifted to the second rotation fulcrum P2 which is further from the press portion 31*c* than the first rotation fulcrum P1, thus, a press force of the press member 30 becomes larger, and the rear end side of the first movable piece portion 22 is pushed further upwardly. At this time, since an abutting position of the press portion 31*c* is shifted to the second abutting portion 22*c*, which is approximately horizontal from the first abutting portion 22*b*, by an abutting of the press portion 31*c* and the second contacting portion 22*c*, each of the movable piece portions 22 and 23 is held as being deformed, and the rotation of the press member 30 toward an opening direction is regulated. Also, due to a change in angles of each of the contacting portions 22*b* and 22*c*, it is possible to feel that the press member 30 is closed when the contacting position of the press portion 31*c* is shifted.

Figure 6A:
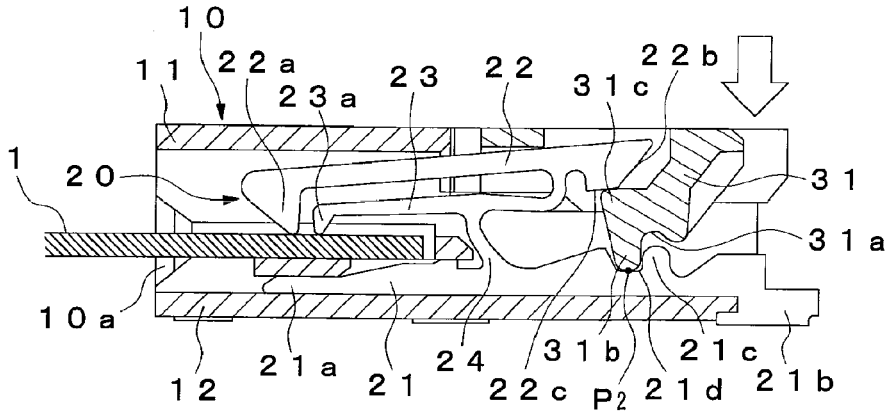
FIG. 6A is a side sectional view showing the opening operation of the connector.
Figure 6B:
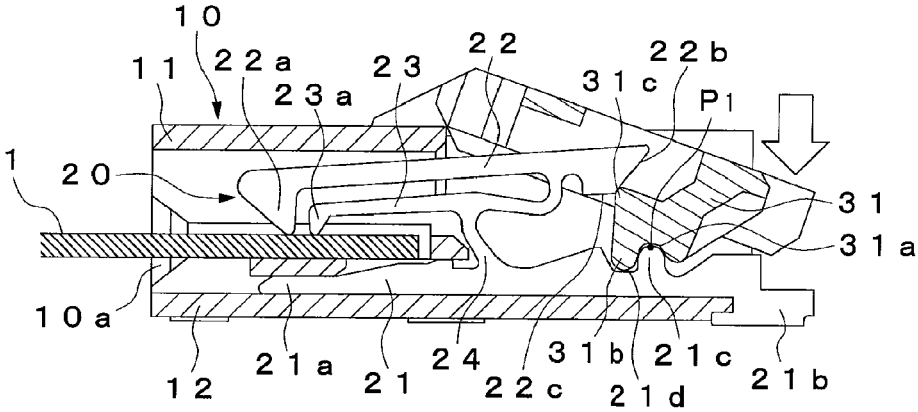
FIG. 6B is a side sectional view showing the opening operation of the connector.
Figure 6C:
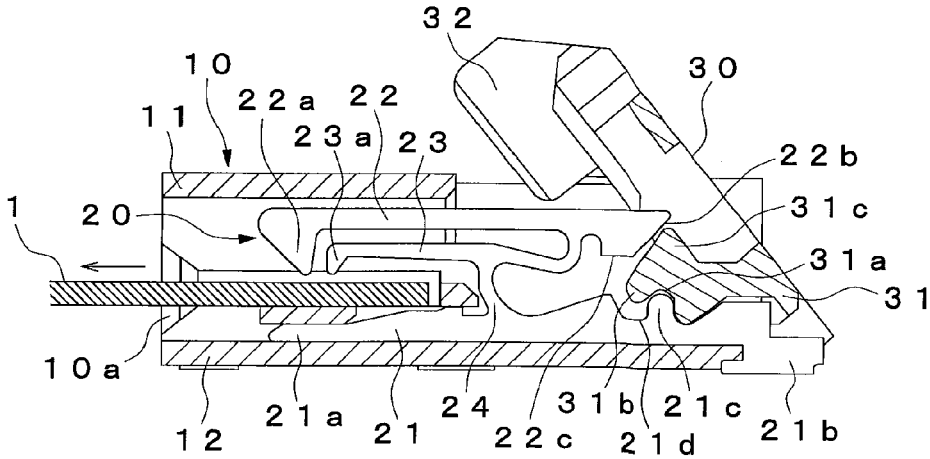
FIG. 6C is a side sectional view showing the opening operation of the connector.

Next, as shown in FIG. 6A, when the rear end side of the press member 30 is pushed downwardly, the second convex portion 31*a* of the press member 30 is engaged with the first convex portion 21*c* as shown in FIG. 6B, the press member 30 rotates on the first rotation fulcrum P1, the front end side of the press member 30 moves upwardly. At this time, the abutting position of the press portion 31*c* is shifted to the first abutting portion 22*b* from the second abutting portion 22*c*. Moreover, when the rear end side of the press member 30 is pushed further downwardly, the pushing press member 30 rotates toward the opening direction as shown in FIG. 6C, and the abutting between the press portion 31*c* and the first abutting portion 22*b* is released. By this, the front end portions of the movable piece portions 22 and 23 are moved upwardly by a restoration force of the springy piece portion 24, the contacting portions 22*a* and 23*a* are detached from the flexible circuit 1 and each of the contacts is released, and the flexible circuit 1 can be extracted from the connector main body 10.

Figure 7A:
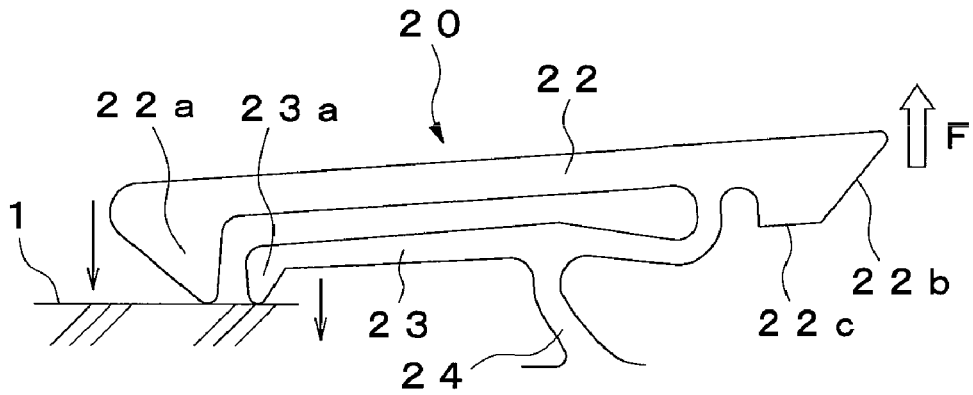
FIG. 7A is an explanatory view of an operation of a contact.
Figure 7B:
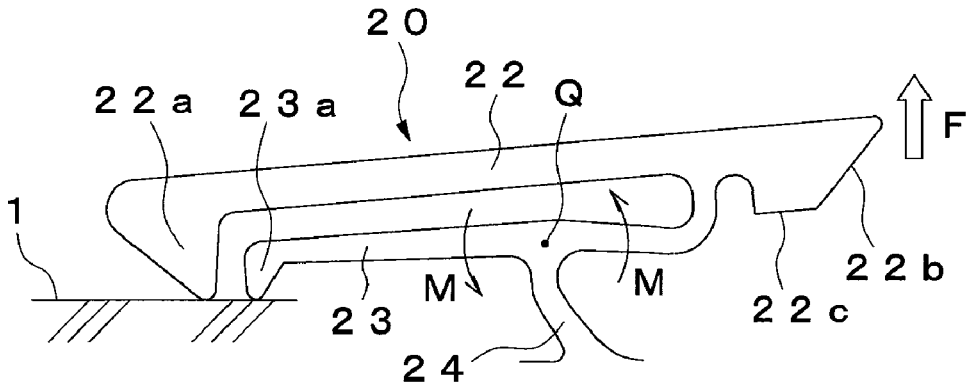
FIG. 7B is an explanatory view of an operation of the contact.

Operations of the contacts 20 when the press member 30 is closed is further explained, as shown in FIG. 7A, when an upward directed force F is generated at the rear end side of the first movable piece portion 22, the first contacting portion 22*a* and the second contacting portion 23*a* are pressed to the upper face of the flexible circuit 1. After that, as shown in FIG. 7B, when a further upward directed force F is generated, the rear end side of the second movable piece portion 23 is moved up by the first movable piece portion 22, and a moment M around a fulcrum Q of the springy piece portion 24 as a center thereof is generated. By this, even after the contacting portions 22*a* and 23*a* are touched tightly the flexible circuit 1 respectively, a downward directed pressing force to the front end side of the second movable piece portion 23 increases, and a contact pressure of the second contacting portion 23*a* becomes higher.

Figure 8:
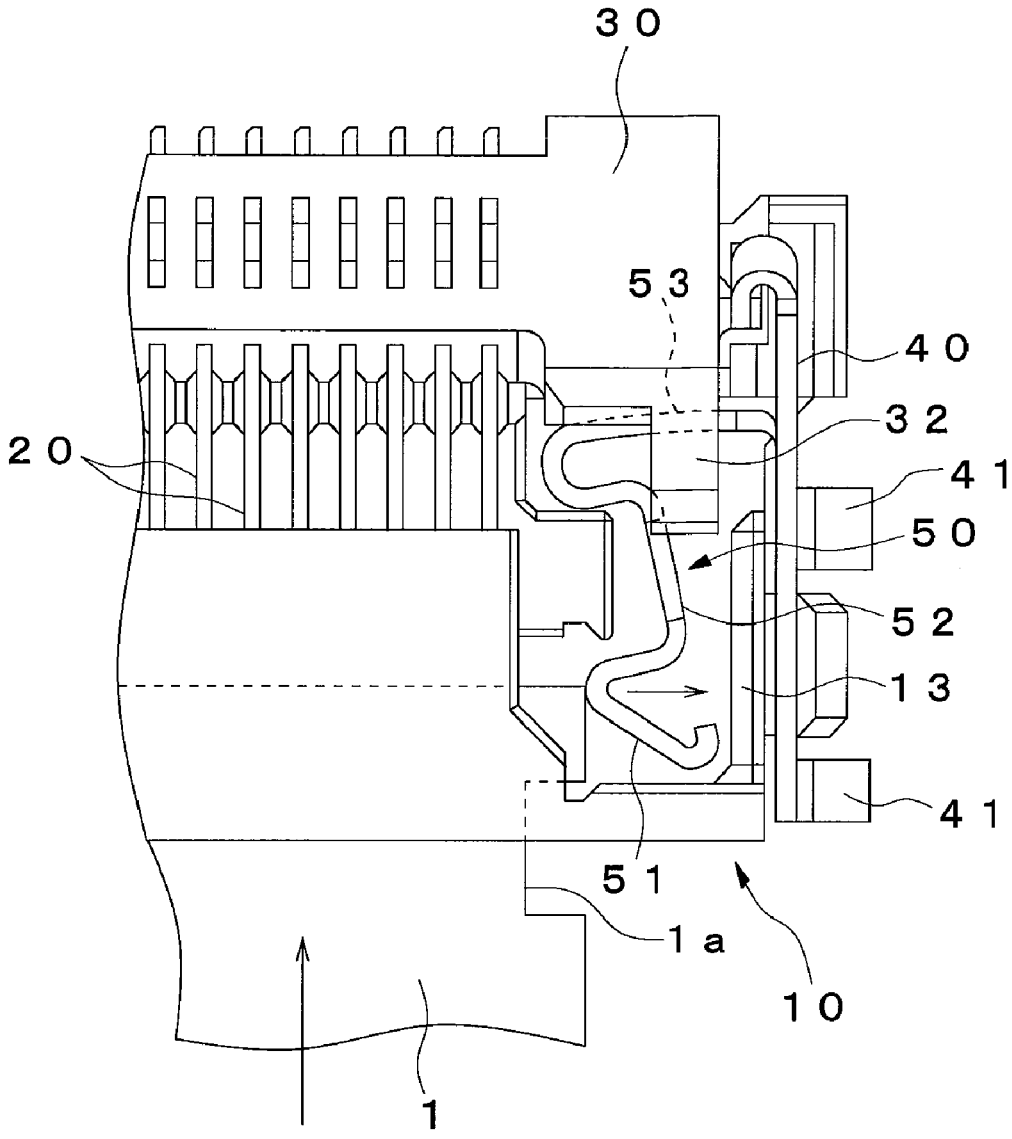
FIG. 8 is a partial plan view of the connector showing an operation of a lock member.
Figure 9:
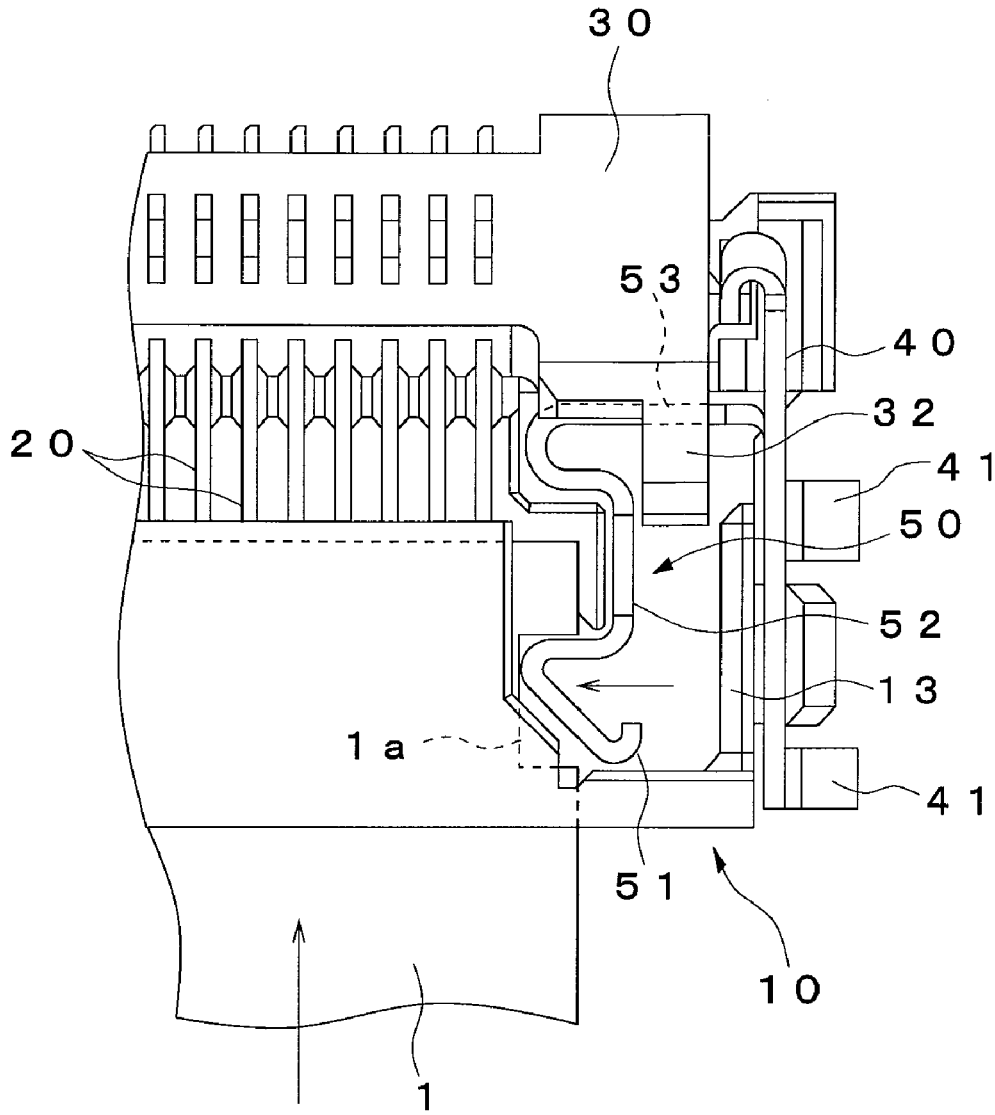
FIG. 9 is a partial plan view of the connector showing an operation of the lock member.
Figure 10:
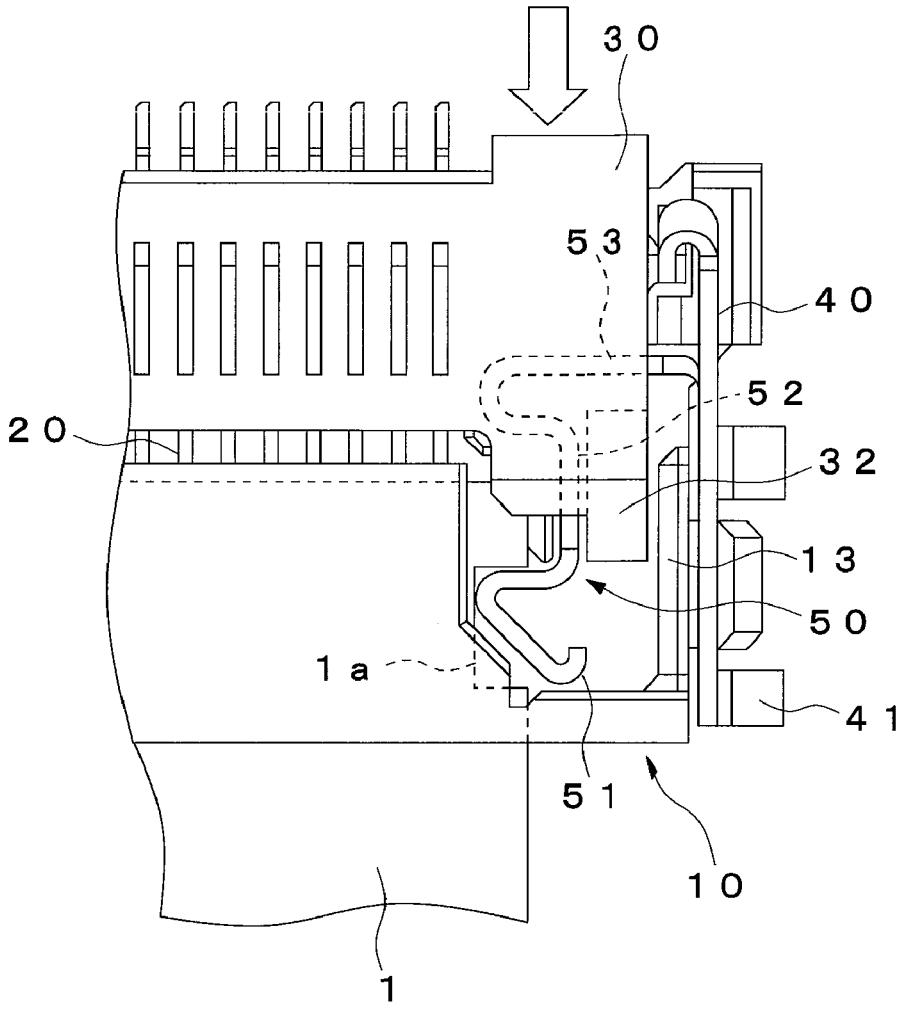
FIG. 10 is a partial plan view of the connector showing an operation of the lock member.
Figure 11:
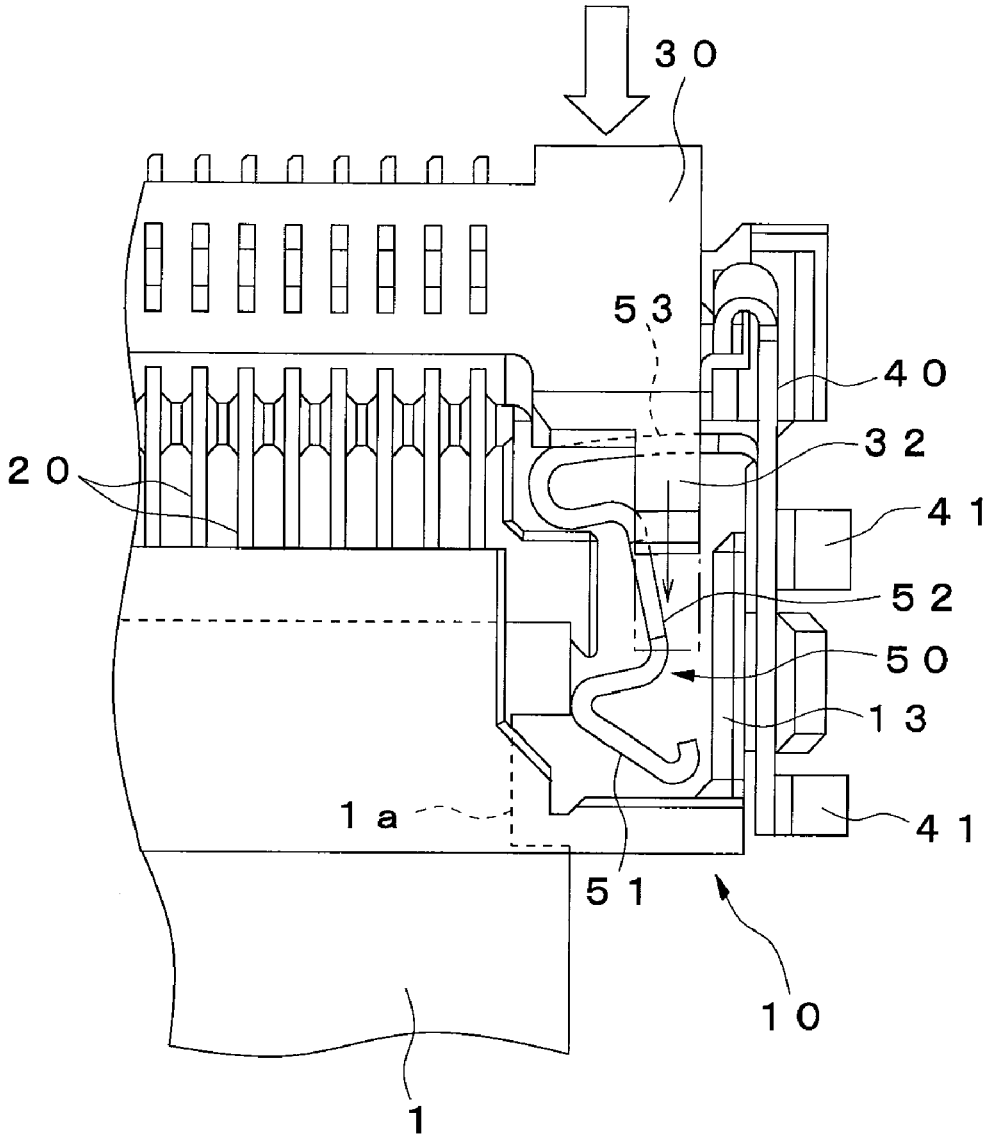
FIG. 11 is a partial plan view of the connector showing an operation of the lock member.

Also, when the flexible circuit 1 is inserted into the insertion slot 10*a* of the connector main body 10, the tip of the flexible circuit 1 abuts against the inclined face of the engagement portion 51 of the lock members 50, as shown in FIG. 8, the engagement portion 51 and movable portion 52 are moved toward outside in the width direction of the connector main body 10. Further, when the flexible circuit 1 is inserted into a predetermined position, as shown in FIG. 9, the engagement portion 51 is engaged with the dented portion 1*a* of the flexible circuit 1, and the engagement portion 51 and the movable portion 52 are moved toward inside in the width direction. By this, the connector main body 10 temporarily holds the flexible circuit 1 by the lock members 50. Next, when the press member 30 is rotated to the closed position, as shown in FIG. 10, the protrude portion 32 of the press member 30 is inserted between the movable portion 52 and the side face portion 13 of the connector main body 10. By this, a movement of the lock members 50 toward outside in the width direction of the lock member 50 is regulated by the protrude portion 32, the flexible circuit 1 becomes completely locked by the lock members 50. As is shown in FIG. 11, when the engagement portion 51 is not engaged with the dented portion 1*a* of the flexible circuit 1 because of an imperfect insertion of the flexible circuit 1, the press member 30 is rotated to the closed direction while the engagement portion 51 and the movable portion 52 are moved toward the outside in the width direction of the connector main body 10, the protrude portion 32 of the press member 30 abuts the movable portion 52, and the rotation of the press member 30 to the closed direction becomes regulated. This prevents the press member 30 from being rotated to the closed position when the flexible circuit 1 is imperfectly inserted.

As such, according to the connector of the present embodiment, the tip of the flexible circuit 1 inserted into the connector main body 10 abuts against the lock members 50, when the pushing press member 30 is rotated toward one side while the lock member 50 is moved toward the outside in the width direction of the connector main body 10, the protrude portion 32 of the pushing press member 30 abuts against the lock members 50, which regulates the rotation of the pushing press member 30, when the pushing press member 30 is rotated toward one direction while the lock members 50 are returned toward inside in the width direction of the connector main body 10, the pushing press member 30 are allowed to rotate. The pushing press member 30 does not rotate to the closed position when the flexible circuit 1 is inserted imperfectly. Therefore, it becomes possible to effectively prevent an incomplete connection caused by the imperfect insertion of the flexible circuit 1.

Also, the flexible circuit 1 is temporarily held by engaging the flexible circuit 1 with the lock members 50, the flexible circuit 1 is not displaced when the pushing press member 30 is rotated, a connection operation of the flexible circuit 1 can easily and certainly be conducted. By this, when the pushing press member 30 is rotated toward the closing position while the flexible circuit 1 is temporarily held by the lock members 50, the movement of the lock members 50 toward outside in the width direction is regulated by the protrude portion 32 of the pushing press member 30. So, the flexible circuit 1 can completely be locked by each of the lock members 50. Therefore, it becomes possible to connect the flexible circuit 1 certainly.

Further, as the lock members 50 can be moved in the width direction of the connector main body 10, it is unnecessary to enlarge the connector main body 10 in the height direction, which is extremely advantageous to make connector main body 10 thinner. In this embodiment, the press member 30 abuts against the lock members 50 which moves toward outside in the width direction of the flexible circuit 1 so that the press force is not applied to the flexible circuit 1 from the lock members 50. Therefore, it is advantageous that the flexible circuit 1 does not get damaged.

Also, the connector main body 10 is formed so that a state of the lock member 50 moving toward the outside in the width direction of the connector main body 10 can be seen from the outside. The imperfect insertion of the flexible circuit 1 can also be confirmed by visual inspection. Therefore, it certainly prevents a connection when the flexible circuit 1 is inserted imperfectly.

Moreover, the lock members 50 are integrally formed with the fixing member 40 for fixing the connector main body 10 at outside. So, a number of parts and an assembly man-hour can be reduced. Therefore, it becomes possible to improve the productivity.

In the present embodiment, if the lock members 50 and the fixing members 40 are made of a conductive material, for example, at a production line, in a case in which an electrode is inserted into the side of the lock members 50 of the connector to which the flexible circuit 1 is connected, and then the electrode touches the lock members 50 which is being moved in the width direction due to the imperfect insertion of the flexible circuit 1, the electrode becomes electrically connected to an other electrode to which the fixing member 40 is connected. Thus, it can be used for a checking process for detecting the imperfect insertion.

In addition, the above embodiment shows the lock member 50 integrally formed with the fixing member 40, however, they can be formed separately, or the connector can be made without the fixing members 40.

DESCRIPTION OF SYMBOLS

1 . . . flexible circuit, 1*a* . . . dented portion, 20 . . . contacts, 21 . . . fixing piece portion, 21*c* . . . first convex portion, 21*d* . . . first concave portion, 22 . . . first movable piece portion, 22*a* . . . first contacting portion, 22*b* . . . first abutting portion, 22*c* . . . the second abutting portion, 23 . . . first movable piece portion, 23*a* . . . second abutting portion, 24 . . . springy piece portion, 40 . . . fixing member, 50 . . . lock member.

The invention claimed is:

1. A connector comprising a connector main body into which an object to be connected can be inserted, a plurality of contacts arranged with spaces in a width direction of the connector main body, a press member capable of rotating for pushing the plurality of contacts toward the object to be connected which is inserted in the connector main body, a lock member which locks the object to be connected by engaging with an engagement portion provided at both width ends of the object to be connected, wherein each of the plurality of contacts is pushed toward the object to be connected by the press member when the press member is rotated toward one direction, and the pushing of the contacts by the press member is released when the press member is rotated toward an other direction, when a tip of the object inserted into the connector main body touches the lock member, the lock member is deformed springy so that the lock member is moved from a predetermined position toward an outside in the width direction of the connector main body, when the lock member engages with the engagement portion of the object to be connected, the lock member moves toward an inside in the width direction of the connector main body and returns to the predetermined position, when the press member is rotated toward the one direction in a state in which the lock member is being moved from the predetermined position toward the outside in the width direction of the connector main body, the both width ends of the press member abut against the lock member from a direction which is perpendicular to the width direction of the connector main body, and the abutting regulates the rotation of the press member, when the press member is rotated toward the one direction in a state in which the lock member is being returned to the predetermined position, the rotation of the press member is permitted.

2. The connector according to claim 1, wherein when the press member is rotated toward the one direction in the state in which the lock member is being returned to the predetermined position, the movement of the lock member toward the outside in the width direction of the connector main body is regulated by the both width end portions of the press member.

3. The connector according to claim 1, wherein the connector main body is formed so that the state in which the lock member is being moved toward the outside in the width direction of the connector main body can be seen from an outside.

4. The connector according to claim 1, further comprising a fixing member for fixing the connector main body to an outside, wherein the fixing member is integrally provided with the lock member.

5. The connector according to claim 1, wherein the engagement portion of the object to be connected is dented portions provided at the both width ends of the object to be connected.

6. The connector according to claim 5, wherein the lock member has an engagement portion to be engaged with the engagement portion of the object to be connected, the engagement portion of the lock member is protruding toward the inside in the width direction of the connector main body.

* * * * *